United States Patent [19]

Jacobson

[11] Patent Number: 4,791,723

[45] Date of Patent: Dec. 20, 1988

[54] DISPOSABLE COMBINATION RAZOR AND SHAVING CREAM DISPENSER WITH MOVABLE CAP

[76] Inventor: Jeff A. Jacobson, 409 Emerald Bay, Laguna Beach, Calif. 92651

[21] Appl. No.: 22,665

[22] Filed: Mar. 6, 1987

Related U.S. Application Data

[63] Continuation-in-part of Ser. No. 819,696, Jan. 17, 1986, abandoned.

[51] Int. Cl.[4] ..... B26B 19/44

[52] U.S. Cl. ..... 30/41; 30/86; 222/402.13

[58] Field of Search ..... 30/41, 86, 90; 222/151, 222/192, 402.13

[56] References Cited

U.S. PATENT DOCUMENTS

| | | | |
|---|---|---|---|
| 2,940,641 | 6/1960 | Norrish et al. | 30/41 UX |
| 2,966,283 | 12/1960 | Darvie | 30/41 UX |
| 3,039,659 | 6/1962 | Sagarin | 222/402.13 |
| 3,139,223 | 4/1964 | Kruck | 222/402.13 |
| 3,399,455 | 9/1968 | Steere | 30/90 |
| 3,417,468 | 12/1968 | Miyauchi | 30/41 |
| 3,726,009 | 4/1973 | Hackmyer | 30/41 |
| 4,077,119 | 3/1978 | Sellera | 30/41 |
| 4,369,901 | 1/1983 | Hidding | 222/151 X |
| 4,433,483 | 2/1984 | Lazarus | 30/41 |

FOREIGN PATENT DOCUMENTS

| | | | |
|---|---|---|---|
| 2583672 | 12/1986 | France | 30/41 |
| 653595 | 1/1986 | Switzerland | 30/41 |

*Primary Examiner*—Douglas D. Watts

*Attorney, Agent, or Firm*—Poms, Smith, Lande & Rose

[57] ABSTRACT

A disposable combination razor and shaving cream dispenser having an aerosol actuated push button shaving cream dispenser and a movable cap having a removable and replaceable razor blade at the upper end. The cap has an internal passageway having the valve stem of the dispenser disposed therein. When the cap is pushed downwardly, the valve stem is depressed which dispenses shaving cream through the passageway. The passageway opens at a point below the razor blade and may open at any point around the outer periphery so as to provide for convenient and safe dispensing of the cream.

20 Claims, 2 Drawing Sheets

Fig. 1.
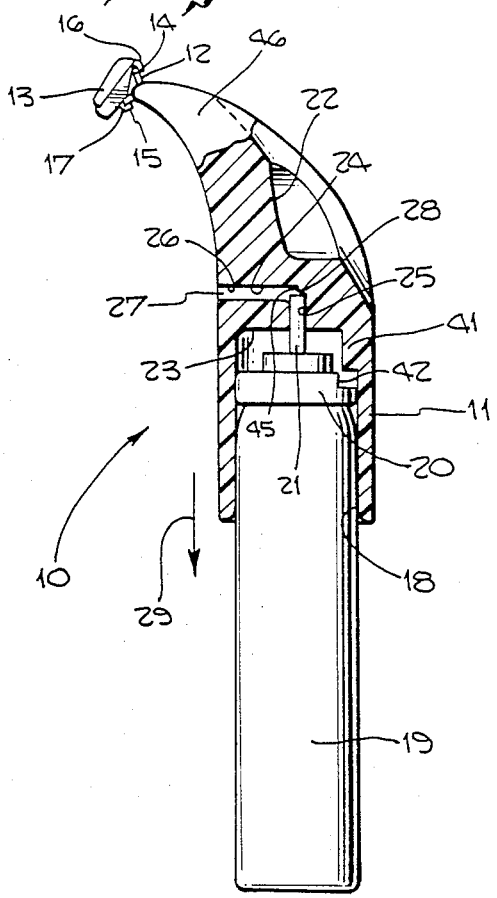
Fig. 2.
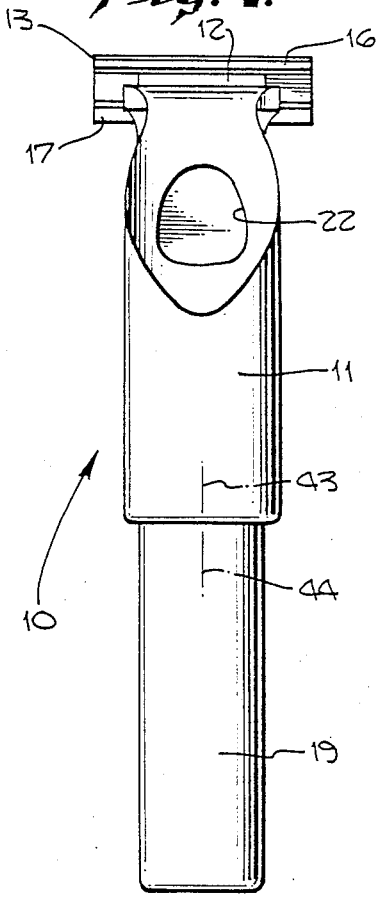
Fig. 4.
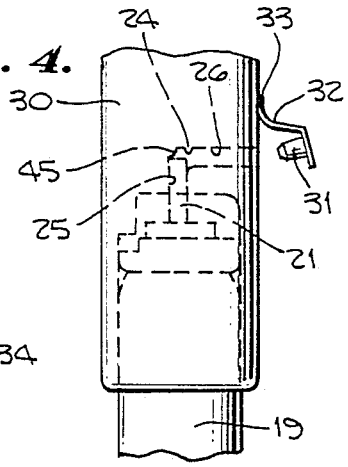
Fig. 5.
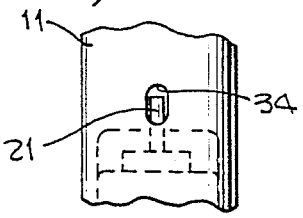
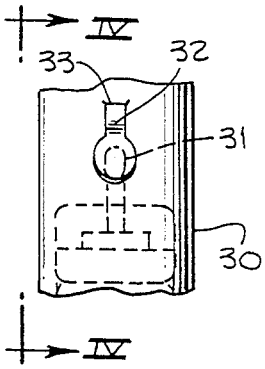
Fig. 3.

DISPOSABLE COMBINATION RAZOR AND SHAVING CREAM DISPENSER WITH MOVABLE CAP

REFERENCE TO RELATED APPLICATIONS

This application is a continuation-in-part of application Ser. No. 06/819,696, filed Jan. 17, 1986, now abandoned.

BACKGROUND OF THE INVENTION

1. Field of the Invention

The invention relates to razor assemblies; and, more particularly, to a disposable combination razor and shaving cream dispenser.

2. Description of the Prior Art

Although electric razors have become popular in recent years, many people still prefer to shave manually. This, of course, requires shaving cream and a razor. When travelling, space is often a problem and one who desires to shave with a razor blade must carry a bulky shaving cream dispenser can in addition to a razor.

In U.S. Pat. No. 4,433,483 to Lazarus, there is described a disposable razor assembly wherein an elongated cylindrical aerosol-operated shaving cream dispenser, of a diameter substantially less than that of a conventional can of shaving cream, is provided. The dispenser body has a cap closing off the top with a razor blade carried by the cap. The cap must be removed from the dispenser body to actuate the push button of the dispenser to dispense the shaving cream.

Thus, the interior of the cap must be kept to close tolerances to provide a tight fit to the top of the dispenser body but allow easy removal. In addition, it is dangerous for the user to have to remove the cap while shaving since the blade is exposed and, since it is part of the cap, it must be gripped in that area to remove the cap. Such caps must be on tight to return the contents therein and not be dislodged when used to shave. For example, men may merely lather their face once while shaving but women may lather their legs or the like many times while shaving in locations, such as a shower, where their hands are wet and soapy. There is thus a strong chance for cutting since the blade is part of the cap and the fit of the cap must be very tight so as not to dislodge when the pressurized shaving cream is applied.

In U.S. Pat. No. 3,726,009 to Hackmyer, a self-lathering shaver is disclosed having an aerosol can where shaving cream is dispensed out of a razor blade attached to the can. This is quite messy and applies shaving cream to the blade thereby dispensing the same while shaving. This is certainly not as effective as applying cream to one's hand where it can be properly rubbed into the face and whiskers of the user to moisturize the same. Thus, there is a substantial amount of waste in the shaver of Hackmyer. The cream comes out of the blades as the blade is touched to the skin with pressure and, thus, one must have such cream coming out constantly to provide sufficient cream for shaving. This uses up a substantial amount of cream quickly which might empty the container in a single use due to the nature of the small size desired for a disposable can thereby rendering the item undesirable and too costly for a disposable item. This feature also makes the prior art device difficult to shave with if the skin is not properly moisturized and might also run out of cream in the middle of a stroke and cut the user.

In some such devices, one's finger is right under the blade when the cream is dispensed. There is a need for such a dispenser where the operator's finger is remote from the blade and the cream is directly dispensed into the palm of one's hand.

There is thus a need for a disposable combination razor and shaving cream dispenser whereby it is not necessary to remove the cap to dispense the shaving cream therefrom and the cream can be dispensed into the hand of the user at a point remote from the razor blade. Such a cap should not have to be manufactured to close tolerances as in prior art devices which must be so manufactured to provide for frequent removal and resealing. Such a device should have a cap which once tightly snapped on, need never be removed.

SUMMARY OF THE INVENTION

It is an object of this invention to provide a disposable combination razor and shaving cream dispenser.

It is a further object of this invention to provide such a razor combination wherein tight critical tolerances are not necessary due to the design herein.

It is still further an object of this invention to provide such a razor combination where shaving cream can be dispensed without removal of the cap or top to a point remote from the razor blade.

These and other objects of the invention are preferably accomplished by providing a disposable combination razor and shaving cream dispenser having an aerosol actuated push button shaving cream dispenser sealed at the top, having a razor blade at the upper end thereof and a movable cap with a passageway receiving therein the actuating valve of the dispenser. The passageway opens out of the cap below the blade. In this manner, the dispenser body may be used as a handle when shaving and the cream may be dispensed directly from the dispenser remote from the blade merely by pushing down on the cap. Ths dispenser herein renders convenience, economy, safety and satisfies a definite need for such disposable device especially when travelling.

BRIEF DESCRIPTION OF THE DRAWING

FIG. 1 is a vertical side view of a combination razor and shaving cream dispenser in accordance with the invention;

FIG. 2 is a rear view of the combination of FIG. 1;

FIG. 3 is a vertical front view of a portion of a modification of the combination of FIGS. 1 and 2;

FIG. 4 is a view taken along lines IV—IV of FIG. 3;

FIG. 5 is a view similar to FIG. 3 showing a modification of the cap of the combination of FIGS. 1 to 4;

DESCRIPTION OF THE PREFERRED EMBODIMENTS

Figure 7:
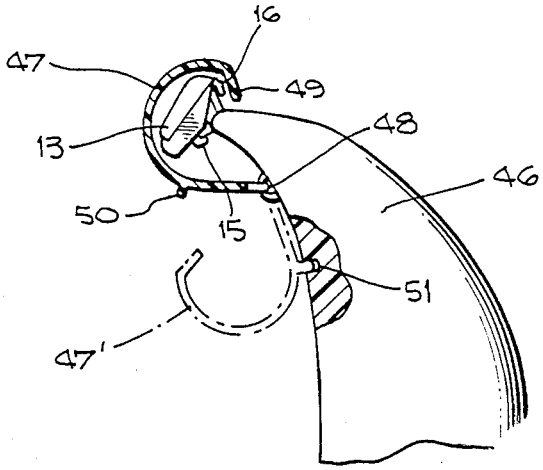
FIG. 7 is a sectional view of a modification of the device of FIG. 1 (only a portion thereof being shown for convenience of illustration.

Referring now to FIG. 1 of the drawing, a combination razor blade holder and shaving cream dispenser device 10 is shown. Device 10 includes a cap 11 provided with a blade holder 12 at its upper end for receiving and retaining therein a conventional razor blade 13. Blade holder 12 may be fixed or pivotally mounted to the upper end of cap 11 and having a pair of outwardly extending flanges 14, 15 adapted to be received within and between a pair of spaced tracks 16, 17 on blade 13. The foregoing is old and well known in the razor blade art.

The cap 11 includes a lower portion open at opening 18 adapted to frictionally fit on the top of a pressurized container 19 which is made of aluminum or any other suitable tubing material, such as plastic or tin, of shaving cream. The upper end of container 19 is sealed off by a collar 20 and a conventional valve stem 21 extends downwardly through collar 20 into the interior of container 19 and in fluid communication with the shaving cream contents therein.

Cap 11 is adapted to snap fit or frictionally fit on the top of container 19 yet be slidable up and down thereon for reasons to be discussed.

Cap 11 also has a depression 22 on the rear thereof (see particularly FIG. 2) for receiving the finger of the operator therein. The interior of cap 11 may have an inner wall 23 generally configured to the upper portion of container 19. An L-shaped passageway 24 extends through the interior of cap 11 having a first generally vertical leg portion 25 opening into the interior of cap 11, below inner wall 23, and receiving therein, in a preferably friction fit relationship, the upper portion of valve stem 21. Passageway 24 further includes a second leg portion 26 integral with first leg portion 25 and preferably curving therefrom and opening at opening 27 through the exterior of cap 11. Portion 26 may be generally horizontally extending as shown but may of course be angled or otherwise diverge from portion 25. Passageway 24 may be oriented.

It is to be understood that valve stem 21 is a conventional valve stem adapted to emit contents under pressure from the interior of container 19 when pushed or moved downwardly in FIG. 1. The overall length of leg portion 25 may be greater than the length of the portion of valve stem 21 disposed therein and valve stem 21 is preferably flat at its top end 28 (or otherwise non-conforming to the inner configuration of passageway 24 where leg portion 25 blends into leg portion 26). Although passageway 24 has been disclosed as being formed out of a solid portion of the interior of cap 11, obviously such passageway could be formed of interconnected tubular sections fixed in position in any suitable manner.

In operation, container 19 is filled with shaving cream under pressure and capped by collar 20 with valve stem 21 extending downwardly into the interior thereof and generally coincident with the central longitudinal axis thereof all as well known in the art. Cap 11 is now placed over the top of container 19 with leg portion 25 being disposed substantially along the longitudinal axis of cap 11 so that valve stem 21 is aligned with leg portion 25 and enters therein in a friction fitting relationship. Of course, any suitable means may be providing for having portion 25 engage and hold stem 21.

Figure 6:
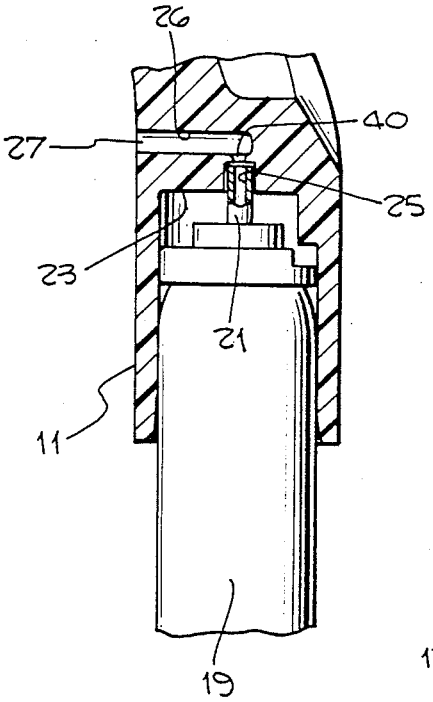
FIG. 6 is side view of the upper portion of a device as in FIG. 1 showing an added feature thereof.

Blade 13 is inserted into blade holder 12. The device 10 is now ready for use. The operator pushes down on cap 11 by inserting his finger into depression 22 and pushing downwardly. Valve stem 21 is moved downwardly either by the friction fit within leg portion 25 or by abutment with the inner surface of passageway 26 arresting its downward movement. For example, as seen in FIG. 6, an inwardly extending annular projection 40, which may be triangular in cross-section, is provided at the intersection of leg portions 25, 26. Thus, no friction fit is necessary since movement of cap 11 downwardly will result in valve stem 21 being pushed downwardly by engagement with projection 40 thereby ejecting foam thereout and out opening 27. The projection 40 also projects inwardly a sufficient distance to form a seal about the opening through valve stem 21 preventing foam leakage thereabout.

Of course, either or both such actuating means may be used. As valve stem 21 moves downwardly in the direction of arrow 29, FIG. 1, shaving cream is dispensed out of passageway 26 and through opening 27. Opening 27 is below blade 13 and remote therefrom. Thus, the cream is dispensed out of the side of the device 10 away from the blade 13 at will as needed to make the device safe and practical.

As seen in FIG. 3 wherein like numerals refer to like parts of the embodiment of FIGS. 1 and 2, cap 30, otherwise similar to cap 11, may have a plug 31 hingedly mounted at hinge 32 (see also FIG. 4) to the outer surface of cap 30 adapted to enter leg portion 26 and plug up the same so that the contents of container 19 cannot be accidentally dispensed. As seen in FIG. 4, plug 31 may be a tapered plug as shown. Also, plug 31, and its hinge 32, may be stamped out of the remainder of cap 30 or fixed thereto at hinge line 33. Of course, any suitable means may be used to prevent the accidental disbursement of shaving cream, such as a sliding member movable over the opening through the cap. For example, as seen in FIG. 1, a projection 41 may be provided on the inner wall 23 above cap 20 with a like configured groove 42 formed in collar 20. As seen in FIG. 2, indicia in the form of arrows 43, 44 on cap 11 and container 19 may be provided. It can be seen that the arrow 43 on cap 11 can be aligned with the arrow 44 on container 19 by rotation of either cap 11 or container 19 with respect to the other. This is the position of projection 41 and groove 42 shown in FIG. 1. If the arrow 43, 44 were not aligned as in FIG. 3, projection 41 would abut against the top of collar 20 and stem 21 would not be activated. Also, as seen in FIGS. 1 and 4, a bead 45 may be provided at the intersection of leg portions 25, 26 to be engaged by stem 21 so that the opening therein would not bottom out against wall 24 and be closed off. Bead 45 is of course not necessary in the FIG. 6 embodiment.

If desired, as seen in FIG. 7, a removable resilient blade protecting cap 47 may be provided having one end hinged at hinge 48 to the upper end 46 of cap 11 and the other end curving over and protecting blade 13. The terminal end 49 may merely abut against end 46 of cap 11 and be swung away therefrom and have a nub 50 adapted to snap fit into a cavity 51 formed in the upper end 46 of cap 11 as seen in FIG. 7 when cap 47 is moved to the dotted line position 47.

Although the passageway 24 in the embodiment of FIGS. 1 to 4 may be generally circular in cross section, as seen in FIG. 5 wherein like numerals refer to like parts of the embodiments of FIGS. 1 to 4, the passageway through cap 11 may be elongated as seen at opening 34, in FIG. 5. Of course, passageway 24 may be rectangular, triangular or any other suitable configuration. The abutment forms a seal with the top of valve stem 21 preventing back pressure and flow of foam underneath the cap.

Figure 8:
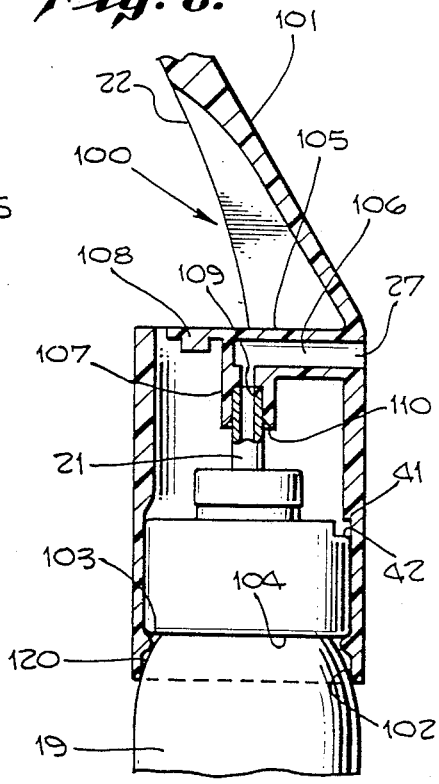
FIG. 8 is a vertical side view of another embodiment of a combination razor and shaving cream dispenser in accordance with the invention.

FIG. 8 is still another embodiment of the invention wherein like numerals refer to like parts of the embodiment of FIG. 1. In this embodiment, device 100 includes a cap 101 provided with a blade holder (not shown) identical to holder 12 of the embodiment of FIG. 1. Cap 101 includes a lower portion open at opening 102 adapted to fit over the top of container 19. Cap 101 has an internal annular bead 103 adapted to snap fit into a peripheral groove 104 formed on the outer wall of container 19. A tapered portion 120 on container 19 leads into groove 104. Cap 101 is not as thick as cap 11, as seen in FIG. 8, and has an L-shaped passageway 105 similar to passageway 24 but formed internally of cap 101 by tubular sections 106, 107. Section 107 is comparable to section 25 of the device 10 of FIG. 1 and section 106 is comparable to section 26 of the device of FIG. 1. However, in this embodiment, the lower portion or wall 108 of cap 101 forms the top wall of section 106 and a stepped inner passageway is formed in section 107 by means of an annular shoulder 109 of an inner diameter less than the outer diameter of stem 21 (the outer diameter of stem 21 being generally related to the inner diameter of section 107 below shoulder 109 so that stem 21 is insertible therein until it abuts against shoulder 109). The area 110 surrounding the opening into section 107 at the lower end thereof may be chamfered to provide a lead into the passageway for quick and easy alignment and assembly. Thus, in this embodiment, there is no need for very close tolerances.

The operation of device 100 is identical to the operation of device 10. Pushing directly down on wall portion 108 flexes the same and allows shoulder 109 to push down on stem 21 to eject foam through passageway 105 and out opening 27 opposite the side moving the blade thereon while the remainder of the cap remains stationary.

The guard 47' for the razor blade and the means for preventing premature ejection of foam, such as projection 41 and groove 42, may be provided in collar 20 of device 100. This embodiment thus may be manufactured in a quick economical manner without need for close tolerances and used quickly and easily as heretofore discussed.

The upper or neck portion of the various caps preferably gracefully blend into the blade holding end thereof to provide an aesthetically pleasing design. Caps 11 and 101, and the modifications thereof, may be resiliently biased on container 19 so that they are normally in the non-valve stem actuating position.

Obviously, where practical, devices 10 and 100 may be made of suitable plastics and molded in one piece. For example, caps 11 and 101 may be molded in one piece. Although a simple connection for the razor blade is provided, obviously any well-known connecting means for a blade may be used. For example, blade holder 12 may be either pivotally mounted to the remainder of cap 11 or 101 or be integral therewith.

Any suitable dimensions may be used except that it is contemplated that the dispenser body be of a size to use the same comfortably as a handle when shaving. The entire device may be discarded when the shaving cream is used up. Since it is a main object of this invention to provide a disposable razor and shaving cream therefor, it is essential that the manufacturing costs be kept as low as possible so that the device may be sold at a price making it attractive to purchasers. The plug 31 and parts 41, 42 act as a guard so that cream is not ejected out of the opening in the cap until the plug is removed or the container rotated and a traveler can transport the device safely and comfortably without concern for accidental discharge of the shaving cream. Finally, since the cap or top need not be removed to dispense shaving cream, it is quite safe and can be used under wet and soapy conditions, as in the shower or the like, without danger of cutting.

Of course, the cap is removable so as to be attachable to another container when that one is empty. Of course, the device may be inexpensive enough so that the entire device is disposed of when the container is empty. Blade 13 may be slid off and another inserted therein. The guide tracks are adapted to hold a conventional readily available razor blade. As discussed, it is not necessary to remove the cap to dispense the cream so the device herein is safer than those prior art devices where the cap removal is needed, by gripping the neck area, to dispense cream; this may result in one cutting one's hands since such hands may be wet and may slip to the blade area. Cream is only effective when dispensed to one's hands, then rubbed into the skin in even layers. Thus, the device herein is more economical than those prior art devices that dispense cream out of the shaving head where it is easily pushed away and may result in the cutting of the skin of the users in areas not covered by cream. The invention is particularly useful for a traveler or in the home for added convenience since the traveler need not carry a great deal of equipment to have a razor and shaving cream therefor and the home user has a device that is safe and practical to use in a single unit.

Although specific embodiments of the invention have been disclosed, obviously modifications thereof may occur to an artisan and the invention is intended to be limited only by the appended claims.

I claim:

1. In a disposable combination razor and shaving cream dispenser having a razor blade assembly at top and a pressurized shaving cream dispenser at bottom, said dispenser being sealed at the top by sealing means with a valve stem extending downwardly through said sealing means into fluid communication with the pressurized contents of said dispenser, the razor blade assembly being part of a cap for the dispenser, the improvement comprising:

said cap having a lower portion mounted to the top of said sealing means, said cap having a recessed portion below the outer planar surface of said cap and rearwardly of said cap of a size for insertion of the finger of an operator and movable downwardly with respect to said sealing means upon downward pressure of a finger of an operator in said recessed portion, said cap having a passageway therein with a first generally vertical leg portion receiving the upper end of said valve stem therein and a second leg portion extending from said first leg portion and both integral and in fluid communication therewith, said cap having an upper portion extending upwardly and outwardly from the lower portion thereof terminating in the razor blade assembly removably holding a razor blade thereon in a manner exposing a sharp edge of said razor blade on one side of said cap, said second leg portion opening at a point exterior of said cap below said upper portion and remote from said razor blade and valve stem moving means associated with both said valve stem and said passageway in said cap to depress said valve stem and eject shaving cream under pressure from said dispenser and out of said second leg portion to the exterior of said cap, said first and second leg portions providing the sole path of travel of said cream from said dispenser out of said opening.

2. In the combination of claim 1 wherein at least a portion of the interior of said cap is solid and said passageway extends through the solid interior portion of said cap.

3. In the combination of claim 1 wherein said second leg portion extends generally horizontally from said first leg portion.

4. In the combination of claim 1 wherein said valve stem moving means includes a friction fit between said valve stem and said first leg portion, the downward movement of said cap with respect to said body depressing said valve stem due to said friction fit.

5. In the combination of claim 4 including an abutment member at the intersection of said leg portions for abutting against said stem.

6. In the combination of claim 4 including indexing means on said cap and said dispenser for aligning said cap with respect to said dispenser to dispense cream when in a first position and prevent dispensing of cream when in a second position.

7. In the combination of claim 1 including means associated with said cap for removably sealing the opening leading out of said cap from said second leg portion.

8. In the combination of claim 7 wherein said sealing means is a removable plug.

9. In the combination of claim 1 wherein said valve stem is coaxial with the longitudinal axis of said dispenser and said first leg portion is also coaxial with the longitudinal axis of said cap so that said valve stem is automatically coaxially aligned with said first leg portion when said cap is disposed on the top of said dispenser.

10. In the combination of claim 1 wherein said passageway is circular in cross section.

11. In the combination of claim 1 wherein said passageway is oblong in cross section.

12. In the combination of claim 1 including removable blade protecting means associated with said cap for covering and protecting said blade when in a first position, and exposing said blade for use when in a second position.

13. In the combination of claim 1 wherein said valve stem is freely movable within said first leg portion and said valve stem moving means includes an inwardly extending annular apertured flange on the wall of said first leg portion adjacent the intersection thereof with said first leg portion whereby, when said cap is pushed downwardly, said stem engages said flange thereby moving said valve stem and ejecting cream out of said dispenser, through said valve stem and out said flange.

14. In the combination of claim 13 wherein the opening through said valve stem is related to the opening through said flange so that a seal is provided between the valve stem and the flange.

15. In the combination of claim 1 wherein said valve stem moving means includes a stepped interior portion on the inner wall of said first leg portion, the stem engaging said stepped interior portion when said cap is moved downwardly.

16. In the combination of claim 1 wherein the opening leading into the lower end of said first leg portion is chamfered to provide a guide for said stem.

17. In the combination of claim 1 wherein said dispenser has an annular peripheral groove and said cap has an inner peripheral bead receivable in said annular peripheral groove.

18. In a disposable combination razor and shaving cream dispenser having a razor blade assembly at top and a pressurized shaving cream dispenser at bottom, said dispenser being sealed at the top by sealing means with a valve stem extending downwardly through said sealing means into fluid communication with the pressurized contents of said dispenser, the razor blade assembly being part of a cap for the dispenser, the improvement comprising:

said cap having a lower portion mounted on to the top of said sealing means and movable downwardly with respect thereto, said cap having a passageway therein with a first generally vertical leg portion receiving the upper end of said valve stem therein and a second leg portion extending from said first leg portion and both integral and in fluid communication therewith, said cap having an upper portion extending upwardly and outwardly from the lower portion thereof terminating in the razor blade assembly adapted to removably hold a razor blade thereon, said second leg portion opening at a point exterior of said cap below said upper portion and remote therefrom, valve stem moving means associated with both said valve stem and said passageway in said cap to depress said valve stem and eject shaving cream under pressure from said dispenser and out of said second leg portion to the exterior of said cap, and indexing means on said cap and said dispenser for aligning said cap with respect to said dispenser to dispense cream when in a first position and prevent dispensing of cream when in a second position.

19. In a disposable combination razor and shaving cream dispenser having a cap with a razor blade assembly at top and a pressurized shaving cream dispenser at bottom, said dispenser being sealed at the top by sealing means having a valve stem extending downwardly through said sealing means into fluid communication with the pressurized contents of said dispenser and with a passageway through said sealing means, the improvement comprising:

push button means associated with said cap accessible from the exterior of said cap and recessed with respect to the outer surface thereof for pushing downwardly on said valve stem to actuate said valve stem without removal of said cap from said dispenser body to dispense cream out of said cap remote from said razor blade assembly and below said razor blade assembly and through an opening in the side of said cap, the remainder of said cap remaining stationary when said valve stem is pushed downwardly to actuate said valve stem and to dispense cream out of said opening.

20. In the dispenser of claim 1 wherein said second leg portion opens exterior of said cap on the same side thereof as the exposed sharp edge of said blade.

* * * * *